United States Patent [19]

Wang

[11] Patent Number: 4,568,569

[45] Date of Patent: Feb. 4, 1986

[54] METHOD AND APPARATUS FOR PROVIDING COMPOSITE METALLIC COATINGS ON METALLIC STRIPS

[75] Inventor: Robert Wang, Wissous, France

[73] Assignee: Stein Heurtey, Orangis, France

[21] Appl. No.: 470,495

[22] Filed: Feb. 28, 1983

[51] Int. Cl.[4] ..... B05D 1/12

[52] U.S. Cl. ..... 427/205; 427/431; 427/433; 118/308; 118/312; 118/304

[58] Field of Search ..... 118/308, 312, 304; 427/205, 431, 433

[56] References Cited

U.S. PATENT DOCUMENTS

| | | | |
|---|---|---|---|
| 1,342,801 | 6/1920 | Gebauer | 427/191 X |
| 2,258,327 | 10/1941 | Kramer | 427/205 X |
| 3,155,530 | 11/1964 | Schnedler . | |
| 3,708,322 | 1/1973 | Jackson et al. | 427/205 X |
| 3,712,826 | 1/1973 | Kimuro et al. | 427/205 X |
| 4,111,154 | 9/1978 | Kissel et al. . | |
| 4,384,546 | 5/1983 | Stahl | 118/699 |

FOREIGN PATENT DOCUMENTS

| | | |
|---|---|---|
| 1446335 | 12/1966 | France . |
| 2065305 | 7/1971 | France . |
| 54-100942 | 8/1979 | Japan . |

OTHER PUBLICATIONS

"Chemical Abstracts", vol. 92, 1980, p. 256, reference 80478 and reference 80479.

*Primary Examiner*—Shrive P. Beck

*Attorney, Agent, or Firm*—Wenderoth, Lind & Ponack

[57] ABSTRACT

A method for depositing composite metallic coatings on a metallic strip, involves bringing in contact with a metallic coating, deposited on the strip by using a continuous dip coating method, before setting of the metallic coating, an additive metal powder in suspension in a gaseous jet. The melting point of the additive metal powder is higher than that of the base coating metal, so that the additive metal powder particles penetrate into the coating in order to obtain a composite structure imparting to the strip an increased corrosion resistance, compared to that provided by a base coating free from additive metal.

5 Claims, 3 Drawing Figures

METHOD AND APPARATUS FOR PROVIDING COMPOSITE METALLIC COATINGS ON METALLIC STRIPS

FIELD OF THE INVENTION

The present invention relates to the production of composite metallic coatings on metallic strips.

BACKGROUND OF THE INVENTION

It is is known that the corrosion resistance of steel strips can be improved by depositing thereon protective layers of coatings of organic or metallic materials. Generally, such coatings are deposited continuously with the assistance of appropriate installations.

The metallic coatings can be deposited on the strips to be protected either by using a dip or electrolytic coating method.

In the dip coating method, the strip is dipped into a bath formed of the melted coating metal. Taking into account the melting points of the metals likely to form an anti-corrosion protective coating, the number of metals which can thus be used is rather limited. They are substantially: tin, lead, zinc, aluminum and all their alloys.

When practicing the electrolytic depositing method of the protective coating, coating metals can be used which have a higher melting point, and which afford anti-corrosion protection which is more efficient than that provided by the hereabove cited coating metals. Among the metals which can be used for electrolytic deposition, nickel or chrome can be named in particular. In addition, this method allows forming coating layers of several superimposed components, or intimately mixed, inside the layers.

It is understandable that the electrolytic deposition method provides a greater flexibility in the formation of the metallic coating layers, and protective coatings of higher corrosion resistance than that obtained by the dip coating method. However, the electrolytic depositing method exhibits the disadvantage that it cannot be associated, directly and in the same installation, with a strip annealing treatment, which is possible in the dip coating metallization installations. It follows from the foregoing that there is presently a need for systems associating a dip coating technology with means allowing forming coating layers containing elements having a high melting point and providing therefore an increased corrosion resistance. Consequently, the present invention provides a method which makes it possible to provide such composite coating layers in a metallization dip coating installation.

OBJECTS AND SUMMARY OF THE INVENTION

The invention calls upon known metallic coating deposition techniques which are used in continuous metallization lines, for example in galvanization lines or aluminization lines, as well as upon techniques, also known, for modifying the crystalline structure of the coating, after metallization, by blowing or spraying finely divided metallic particles in suspension in a gas jet, before setting of the coating.

The method which is the object of the present invention is essentially characterized in that the additive metal powder in suspension in the gaseous jet is brought in contact with the metallic coating deposited on the strip by using the continuous dip coating technique, before setting of the coating, so that the particles of the additive metal powder penetrate into the coating in order to form a composite structure imparting to the strip an increased corrosion resistance compared to that provided by a base coating free of additive metal.

The metallization method used in the method according to the invention can be that which is practiced in many continuous galvanization lines. With regard to the deposition technique of additive metal for modifying the crystalline structure of the coating deposited by a dip coating technique, the so-called "minispangle" method can be used, disclosed in French Pat. No. 1 446 335 and in U.S. Pat. No. 4,111,154. According to this method, pulverulent zinc particles in suspension in a carrier-gas can be blown or sprayed onto the surface of a sheet metal emerging from a galvanization bath, in order that the zinc sets on the surface. However, and contrary to the zinc powder minispangle method which requires that the coating be set or solidified prior to leaving the apparatus, the method which is the object of this invention makes independent the blowing of the additive metal powder and the setting of the coating which can occur subsequent to its passage through the equipment.

The method according to the invention is particularly applicable to the addition of nickel or nickel alloy powder to a zinc or zinc alloy coating. It applies also to the addition of nickel powder to a zinc coating provided in the form of an iron-zinc alloy.

According to a feature of this invention, the concentration of the additive metal powder deposited in the base coating is between 0.1 and 15% by weight of the coating, and preferably between 0.5 and 3% by weight.

According to a further feature of this invention, the granulometry of the additive metal powder deposited in the base coating is between 0.5 and 20 microns, and preferably between 1 and 5 microns.

According to the invention and by way of a non limiting example, sheet metals have been produced with the addition of nickel powder on an industrial galvanization line. The manufacturing conditions were the following:

line speed . . . 23 m/mn
steel thickness . . . 0.75 mm
coating surface density . . . 250 g/m$^2$ (2 faces)
granulometry of nickel powder . . . 2.5$\mu$
nickel content of coating . . . 0.8 to 3.65% by weight The characteristic coating obtained with the method according to the invention contains mainly zinc phase $\eta$ (êta) with iron-zinc alloy crystals at the steel-coating interface. The additive metal (of nickel in the instant example) is present in the whole coating, at the joints of the grains of the zinc phase $\eta$. It exhibits a concentration increase in the vicinity of the coating surface. Such increase leads to an improvement of the resistance of the coating to corrosion accelerated in a salt spray.

Tests made on the samples produced in the hereabove specified conditions have given the following results:

resistance to the salt spray (test according to AFNOR NFA 41 002 standard) of the coating without addition of nickel . . . 240 hours;
resistance of the coating of same weight with addition of nickel . . . 694 hours.

Of course, the invention is not limited to the example and can be applied to combinations of different elements capable of forming simultaneously the base coating and the additive metal, it being understood that the additive metal melts at a higher temperature than the coating metal.

An apparatus for conducting the method of the invention comprises a housing formed of the assembly of two symmetrical casings forming therebetween a vertical gap or passage through which the strip is caused to travel continuously, the strip being provided with the base coating deposited by the dip coating method, and blowing slots or groups of openings formed in the housing in order to blow or spray the additive metal powder in suspension in a gaseous jet on the surface of the strip provided with the base coating, such blowing preferably being performed in a direction substantially at right angles to the strip. A recirculation fan feeds the blowing slots or groups of openings. Recovery slots or groups of openings are formed in the housing in order to collect the gas still loaded with metallic powder for directing it toward the aspiration or suction side of the recirculation fan, where a metering means adds up the required quantity of power which has to be blown onto the strip. An aerodynamic joint is provided at each end of the housing, in order to prevent the recirculated gas loaded with metallic powder from escaping into the environment.

BRIEF DESCRIPTION OF THE DRAWINGS

Further features of this invention will become more apparent from the hereafter description, with reference to the accompanying drawings which illustrate, by way of non limiting examples, three embodiments of installations according to the invention. In the drawings.

DETAILED DESCRIPTION OF THE INVENTION

Figure 1:
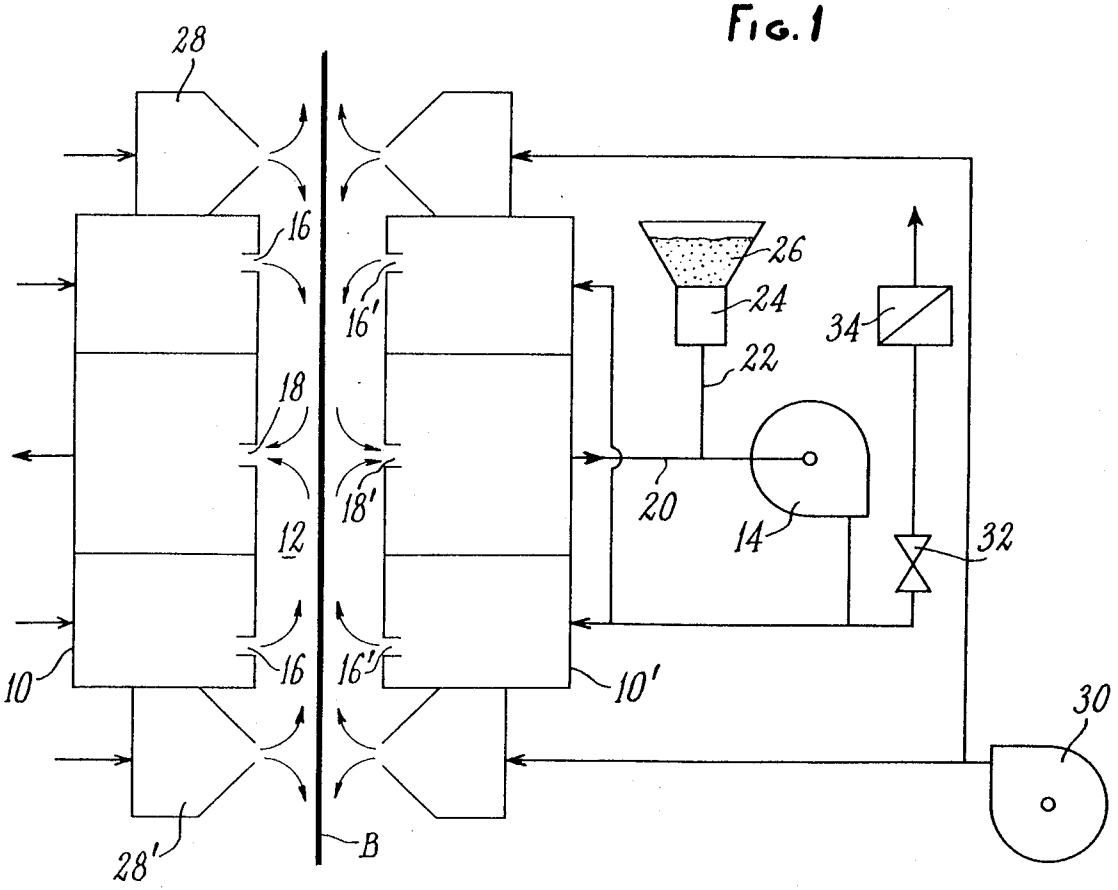
FIGS. 1 through 3 are schematic views illustrating such installations.

Reference is first made to FIG. 1.

In FIG. 1 are shown schematically at 10 and 10' two symmetrical casings forming a device housing, such casings being arranged so as to provide a substantially vertical passage 12, in which the strip B provided with a base coating deposited by a dip coating method is caused to travel continuously. The installation comprises a recirculation fan 14 feeding blowing slots such as 16, 16', or groups of circular openings, blowing or spraying on strip B gas having in suspension the particles of the additive metal, for example nickel powder, the blowing being performed preferably in a direction substantially at right angles to the strip. In this embodiment, the blowing slots or groups of openings 16, 16' are located at the ends of the blowing housing.

In addition, the blowing housing is formed with recovery slots or groups of circular openings such as 18, 18', collecting the gas still loaded with metallic powder for directing it toward the aspiration of the recirculation fan 14. In a recovery duct 20 opens a powder feeding duct 22, feeding the required metallic quantity to be blown on the coating of strip B. To this effect, the apparatus comprises a storage hopper 26 for the additive metal powder, and a powder metering apparatus 24. In the embodiment shown in FIG. 1, the recovery slots or groups of openings 18, 18' are located in the central portion of the housing.

Moreover, there is provided at each end of casings 10, 10' of the housing an aerodynamic joint 28, 28' respectively for preventing the recirculated gas, loaded with metallic poder, from being released outside of the housing. Aerodynamic joints 28, 28' are provided in the form of blowing slots for the projection at a high speed of fresh gas against strip B, such slots being fed by a fan 30.

According to the invention, there is foreseen a leak for the blown gas prior to its reaching the blowing housing, in the recirculation system, in order to better control the tightness of the device to the ambient air, the leak being compensated by an admission of fresh air in the recirculation system. In this embodiment, the leak is provided by a valve 32, while a filter 34 is mounted on the exhaust of such valve in order to collect the metallic powder particles with which the gas is loaded before evacuation of the environment.

Figure 2:
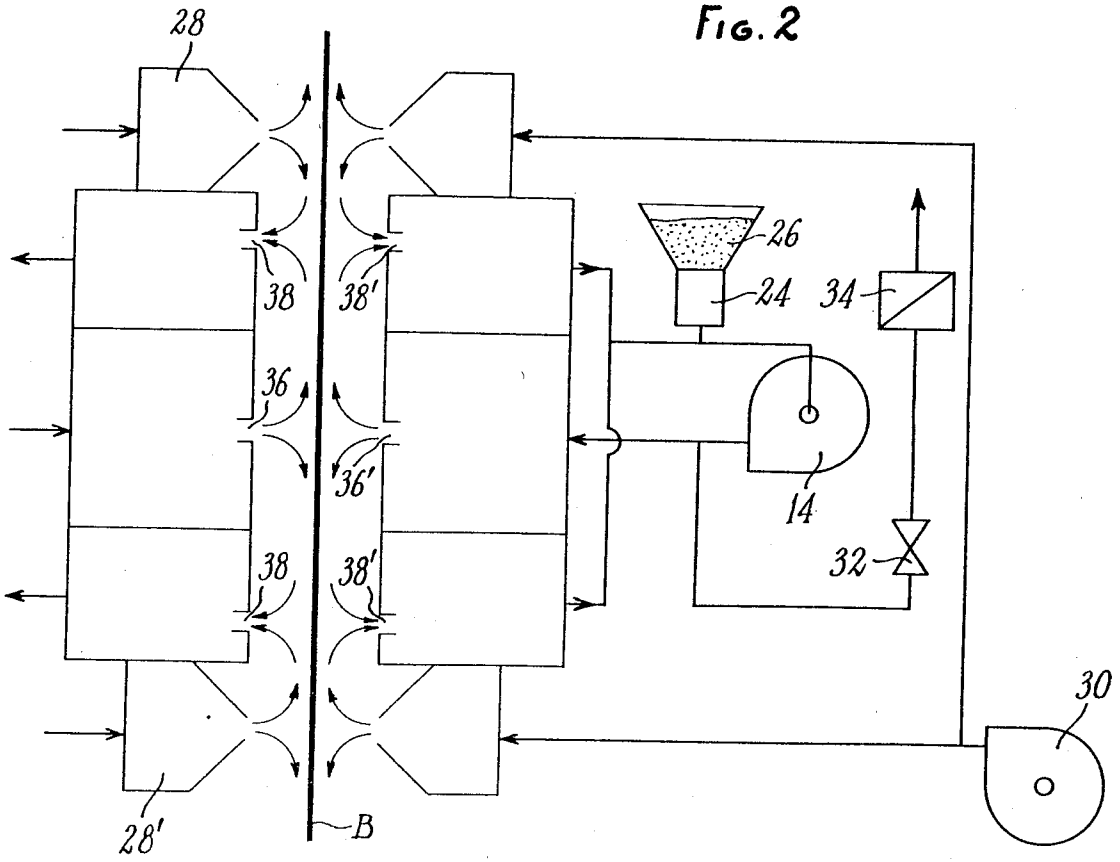

Reference is now made to FIG. 2 which shows another embodiment of the apparatus according to the invention. This alternative embodiment is identical to the apparatus hereabove described with reference to FIG. 1, except for the disposition of the blowing and recovery slots. In this embodiment, the blowing slots or groups of openings 36, 36' are located at the center of the housing, and the recovery slots or groups of openings 38, 38' are positioned at the ends of the housing.

Figure 3:
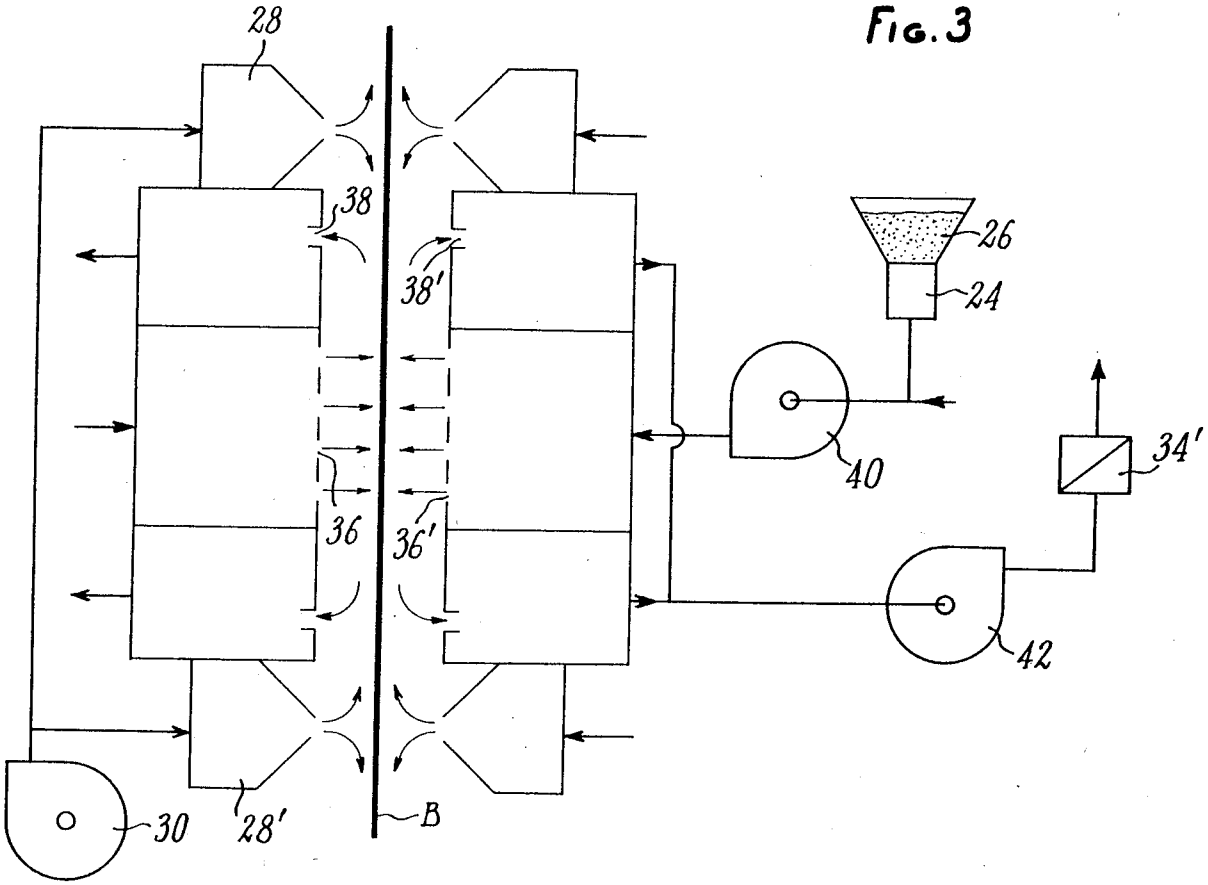

In the embodiment shown in FIG. 3, the disposition of the group of blowing openings 36, 36' and of the recovery slots 38, 38' is the same as in the embodiment illustrated in FIG. 2. However, seperate fans are used for the blowing and recovery operations. In fact, the installation comprises a blowing fan 40, fed with additive metal powder via hopper 26 and the metering system 24, and a recovery fan 42, at the outlet of which is mounted a filter 34'. The recovery fan has a delivery rate equal to or higher than that of the blowing fan.

Of course, and without departing from the scope of the invention, other dispositions and arrangements may be considered regarding the blowing and recovery slots or openings, the fans, the filters, etc., as well as the use of the method in protective gas environment.

What I claim is:

1. A method for depositing composite metallic coatings on a metallic strip, said method comprising:

depositing on a metallic strip, by a continuous dip coating method, a metallic base coating formed of zinc, zinc alloys or aluminum, or of an iron-zinc alloy;

before setting of said base coating, bringing into contact therewith an additive powder of nickel or nickel alloy in suspension in a gaseous jet, the melting point of said additive powder being higher than that of said base coating; and whereby, particles of said additive powder penetrate into said base coating, thereby forming a composite structure having an increased corrosion resistance compared to that provided by the base coating free of said additive powder.

2. A method as claimed in claim 1, wherein the concentration of said additive powder deposited in said base coating is between 0.1 and 15% by weight of said base coating.

3. A method as claimed in claim 2, wherein said concentration is between 0.5 and 3% by weight of said base coating.

4. A method as claimed in claim 1, wherein the granulometry of said particles of additive powder deposited in said base coating is between 0.5 and 20 microns.

5. A method as claimed in claim 4, wherein said granulometry is between 1 and 5 microns.

* * * * *